US007662015B2

(12) United States Patent
Hui

(10) Patent No.: US 7,662,015 B2
(45) Date of Patent: Feb. 16, 2010

(54) INTERACTIVE TOY UNICORN

(76) Inventor: Man Kit Hui, 312-5 Peninsula Centre, 67 Mody Road, TST East, Kowloon, Hong Kong (HK)

( * ) Notice: Subject to any disclaimer, the term of this patent is extended or adjusted under 35 U.S.C. 154(b) by 413 days.

(21) Appl. No.: 11/842,380

(22) Filed: Aug. 21, 2007

(65) Prior Publication Data

US 2009/0053969 A1 Feb. 26, 2009

(51) Int. Cl.
*A63H 33/26* (2006.01)

(52) U.S. Cl. ..... 446/130

(58) Field of Classification Search ..... None
See application file for complete search history.

(56) References Cited

U.S. PATENT DOCUMENTS 5,061,217 A * 10/1991 Miller et al. ..... 446/61
D472,944 S * 4/2003 Jacobs ..... D21/620
2008/0032790 A1* 2/2008 Zielinski et al. ..... 463/31

* cited by examiner

*Primary Examiner*—Ronald Laneau
*Assistant Examiner*—Tramar Harper
(74) *Attorney, Agent, or Firm*—Eric Hanscom; Todd J. Langford; Inter Continental IP

(57) ABSTRACT

An interactive toy unicorn is disclosed, where the unicorn can emit sounds and flap its wings. Pressing a button on the unicorn's head, where this button also doubles as the unicorn's horn, will trigger this functionality. Alternatively, the unicorn will emit sound and flap its wings if a magnet is placed over a magnetic switch located in the nose of the unicorn. This magnet can be placed inside of a toy wand, to give a magical effect to the toy unicorn. Lights can be placed inside the wings and light up when the wings flap.

17 Claims, 4 Drawing Sheets

INTERACTIVE TOY UNICORN

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of toys, and more specifically toward an interactive toy unicorn, where the unicorn can emit sounds and flap its wings. Pressing a button on the unicorn's head, where this button also doubles as the unicorn's horn, will trigger this functionality. Alternatively, the unicorn will emit sound and flap its wings if a magnet is placed over a magnetic switch located in the nose of the unicorn. This magnet can be placed inside of a toy wand, to give a magical effect to the toy unicorn. Lights can be placed inside the wings and light up when the wings flap.

For years, children have enjoyed playing with toy unicorns. This mythical creature has been depicted many different ways through the ages. One such embodiment of this mythical creature includes a horn on the forehead of the unicorn, and wings on its back.

Toy unicorns have been around for many years. As times have progressed, these toys have become more and more sophisticated. Batteries and electronics have been added to these toys, as well as moving parts. Children and parents continue to expect more technologically advanced features present in the toys they purchase. Interactive toys stimulate children's interests and keep them entertained for longer periods of time.

Thus there has existed a long-felt need for a toy unicorn where the user can interact with the unicorn. It should not only produce sound and movement, but also allow the child to interact with the unicorn in a manner consistent with the mythology and folklore behind the unicorn.

The current invention provides just such a solution by having an interactive toy unicorn, where the unicorn can emit sounds and flap its wings. Pressing a button on the unicorn's head, where this button also doubles as the unicorn's horn, will trigger this functionality. Alternatively, the unicorn will emit sound and flap its wings if a magnet is placed over a magnetic switch located in the nose of the unicorn. This magnet can be placed inside of a toy wand, to give a magical effect to the toy unicorn. Lights can be placed inside the wings and light up when the wings flap.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

SUMMARY OF THE INVENTION

This invention is a toy unicorn, where the user can interact with the unicorn and cause it to produce sound and flap its wings. It includes a power source, an integrated circuit, a button, a magnetic switch, a motor, wings, a speaker, and optionally lights.

The user can cause the unicorn to emit sound and flap its wings in one of two ways. First, the user may press on the unicorn's horn. The horn is also a button. Pressing this horn button causes the unicorn to emit sound and flap its wings. This button could be located in another part of the unicorn, such as the ears, nose, tail, or other appropriate body section without losing the functional purpose of the button. If the button were located in another part of the body, it would not resemble the horn of the unicorn; rather it would resemble the body part where the button is located. Second, the user can wave a wand over the nose of the unicorn. The end of the wand contains a magnet, which triggers the magnetic switch located in the nose of the uniform. It is important to note, however, that the magnetic switch could be placed in other locations in the unicorn, such as behind the head, in the neck, back, posterior, or other appropriate body section of the unicorn without losing the functional purpose of the switch. The wand would then be waved over that location to trigger the magnetic switch thereby causing the unicorn to emit sound and flap its wings.

The toy unicorn can also have lights located inside of the wings. When either the magnetic switch is activated or the horn button is pressed, not only will the toy unicorn emit sound and flap its wings, but its wings will also light up. While the wings are flapping the lights can be on constantly, blink in a continuous manner, or flash on and off randomly. These lights are preferably LED lights, because of their low power requirements and durability.

An integrated circuit is used to process signals from the horn button and the magnetic switch. Whenever the integrated circuit receives a signal from one of these two sources, it outputs signals to the speaker, electronic motor, and optionally lights. When the electronic motor is activated, it causes the wings on the unicorn to flap up and down. The speaker can emit various sounds, but preferably horse-like sounds or other sounds that one would normally hear from a unicorn should be emitted.

After a set period of time, such as 60 seconds, the toy unicorn can enter a low power mode. While in this mode, the integrated circuit will not respond to any signals from the magnetic switch. If the horn button is pressed, however, then the toy unicorn will leave the low power mode, and then will once again respond to signals from the magnetic switch. This low power mode is intended to save power and extend the useful life of the batteries used to power the toy unicorn.

Batteries power the integrated circuit and connected electronic components, preferably "AAA" sized batteries. The batteries are configured to meet the voltage requirements of the integrated circuit.

It is a principal object of the invention to provide a child's toy that imitates a mythological creature.

It is another principal object of the invention to provide a child's toy that is fun and entertaining to use.

It is a final object of this invention to provide a child's toy that is safe and efficient to operate.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

Figure 1:
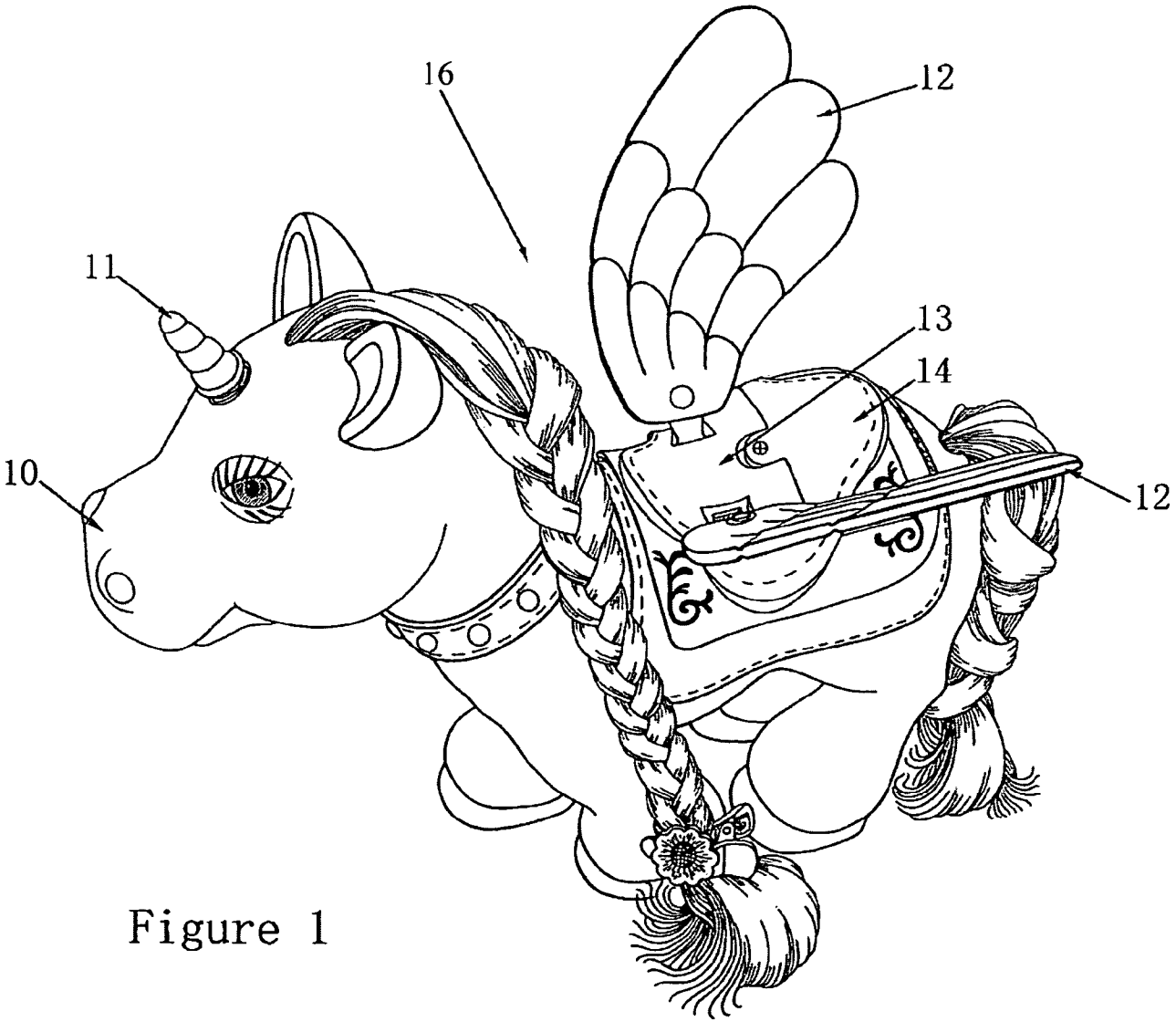
FIG. 1 is a perspective view of the toy unicorn.

FIG. 1 is a perspective view of the toy unicorn. A magnetic switch (not shown in this figure) is located in the nose 10 of the toy unicorn 16. There is a button 11 that is also the horn, or horn button, of the toy unicorn 16. By pressing the button 11, the toy unicorn 16 flaps its wings 12. The motor is located in the body 13 of the toy unicorn 16. The battery cover 14, which allows access to replace the batteries, is located near the tail of the toy unicorn 16. Optional lights (not shown in this figure) can be placed in the wings 12. If lights are placed in the wings 12, the wings 12 should be transparent or translucent to allow the user to see the light emitted from the lights.

Figure 2:
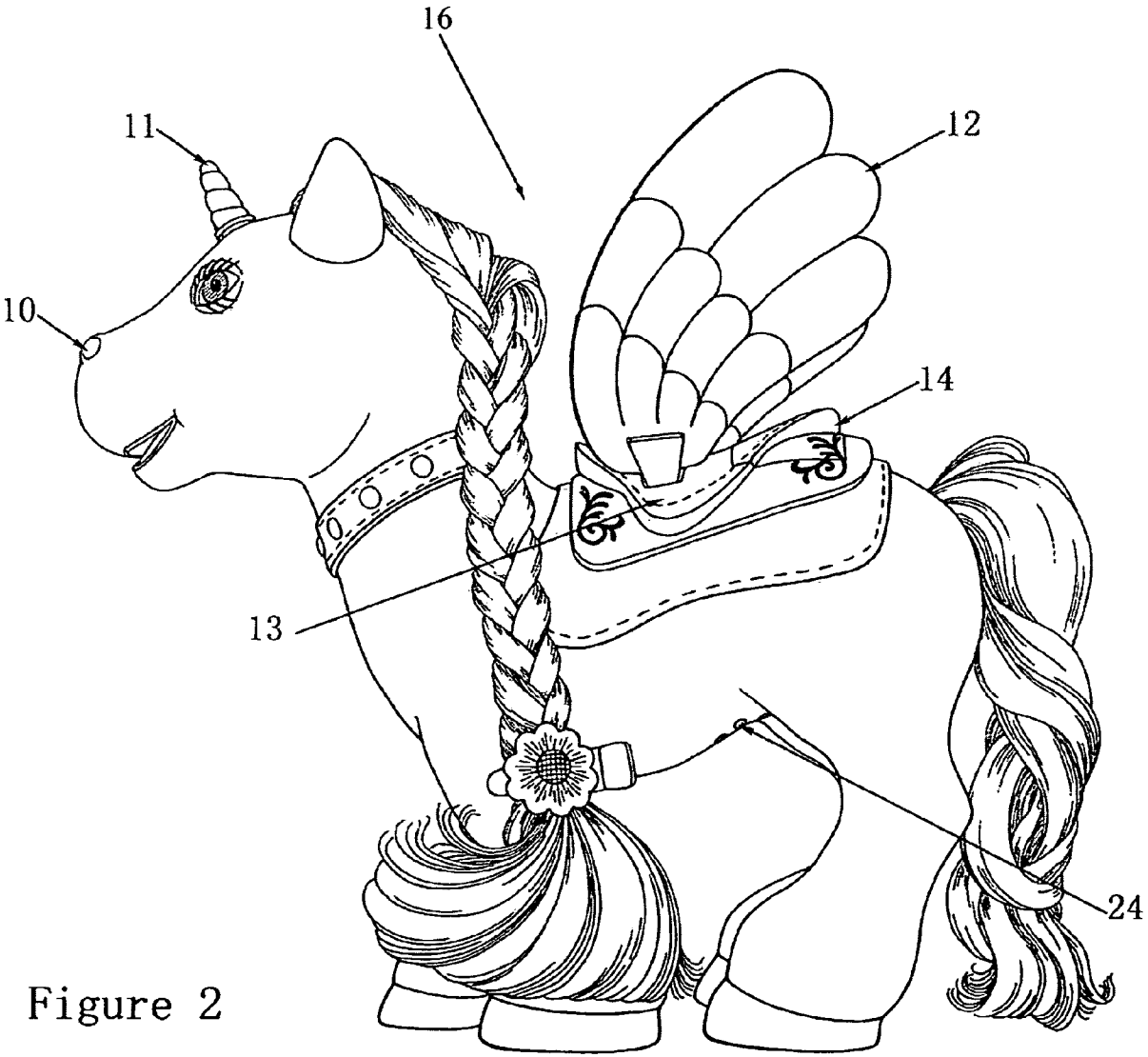
FIG. 2 is a side view of the toy unicorn.

FIG. 2 is a side view of the toy unicorn. A magnetic switch (not shown in this figure) is located in the nose 10 of the toy unicorn 16. There is a button 11 that is also the horn, or horn button, of the toy unicorn 16. By pressing the button 11, the toy unicorn 16 flaps its wings 12 and sound comes out of the speaker (not shown in this figure), which is located in the abdomen 24 of the toy unicorn 16. The motor is located in the body 13 of the toy unicorn 16. The battery cover 14, which allows access to replace the batteries, is located near the tail of the toy unicorn 16.

Figure 3:
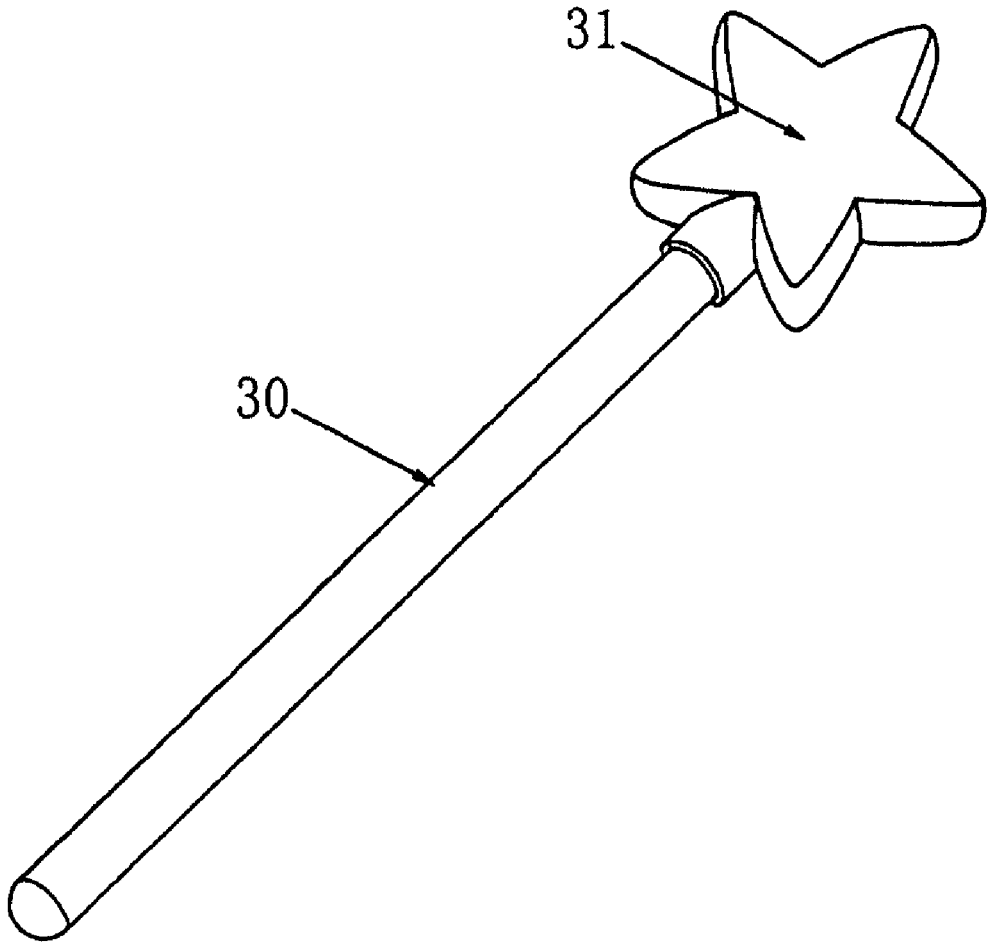
FIG. 3 is a front view of the magic wand.

FIG. 3 is a front view of the magic wand. The magic wand 30 has a magnet placed inside of the head 31 of the wand. This will trigger the magnetic switch located in the toy unicorn (not shown in this figure).

Figure 4:
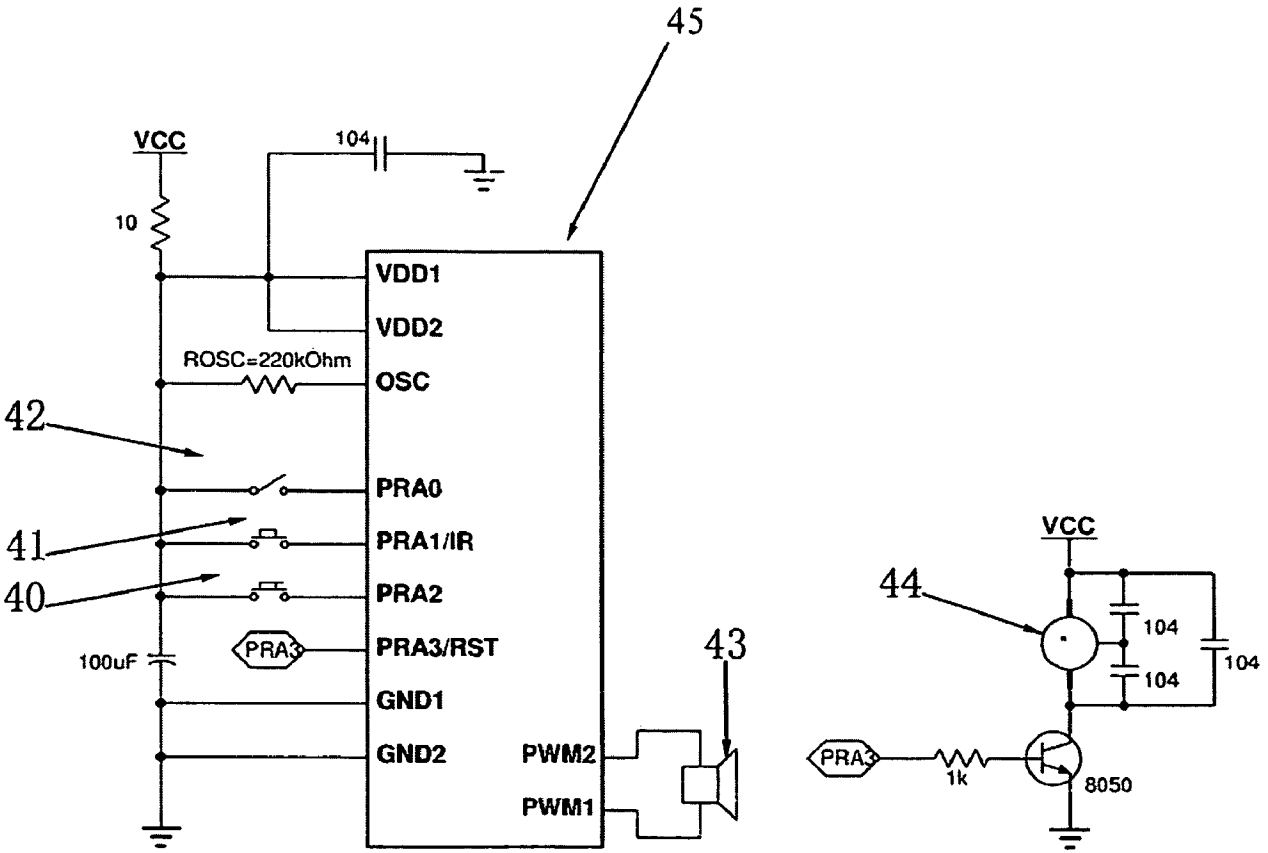
FIG. 4 is a schematic view of the integrated circuit used in the toy unicorn.

FIG. 4 is a schematic view of the integrated circuit used in the toy unicorn. If either the magnetic switch 40 is activated or the horn button 41 is pressed, a signal is sent to the integrated circuit 45. The integrated circuit 45, upon receiving this signal, sends a signal to the speaker 43, causing it to emit sound, and to the motor 44 causing the motor 44 to turn. When the motor 44 turns, the wings flap up and down. There are also various resistors, capacitors, and transistors used in the circuit.

What I claim is:

1. A child's toy comprising a toy unicorn, where the unicorn resembles a horse with a horn on its head, wherein the head is attached to a body having four legs, and where the toy unicorn comprises a power source, a speaker, an integrated circuit, a button, a motor, a magnetic switch, and wings on said body, where the power source supplies electricity to the integrated circuit where the speaker and the motor are connected to the integrated circuit, and where the integrated circuit can send a signal to the speaker causing it to emit sound and where the integrated circuit can send a signal to the motor causing it to turn, where the motor is connected to the wings, and when the motor turns, the wings flap up and down, where the button is connected to the integrated circuit and, when the button is pressed, sends a signal to the integrated circuit where the integrated circuit, upon receiving this signal, causes the wings to flap, the speaker to emit sound, or both, and where the magnetic switch is triggered by creating a magnetic field in close proximity to the magnetic switch, and where the magnetic switch is connected to the integrated circuit and, when the switch is activated, sends a signal to the integrated circuit, where the integrated circuit, upon receiving this signal, causes the wings to flap, the speaker to emit sound, or both.

2. The child's toy of claim 1, where the magnetic switch is located in a nose of the toy unicorn.

3. The child's toy of claim 1, where the button is also the horn of the unicorn.

4. The child's toy of claim 1, where the speaker emits sounds of a horse running.

5. The child's toy of claim 1, where the speaker emits sounds of a horse neighing.

6. The child's toy of claim 1, where the speaker is located in a abdomen of the toy unicorn.

7. The child's toy of claim 1, where the toy unicorn has a lower power mode, and where the integrated circuit, when the toy unicorn is in the low power mode, will not respond to signals from the magnetic switch, but upon receiving a signal from the button, will once again respond to signals from the magnetic switch.

8. The child's toy of claim 1, where the toy unicorn further comprises lights, where these lights are located in the wings, and where the lights are constantly lit while the wings are flapping.

9. The child's toy of claim 1, where the toy unicorn further comprises lights, where these lights are located in the wings, and where the lights flash on and off while the wings are flapping.

10. A child's toy comprising a toy unicorn, where the unicorn resembles a horse with a horn on its head, wherein the head is attached to a body having four legs, and where the toy unicorn comprises a power source, a speaker, an integrated circuit, a button, a motor, a magnetic switch, and wings on said body, where the power source supplies electricity to the integrated circuit where the speaker and the motor are connected to the integrated circuit, and where the integrated circuit can send a signal to the speaker causing it to emit sound and where the integrated circuit can send a signal to the motor causing it to turn, where the motor is connected to the wings, and when the motor turns, the wings flap up and down, where the button is connected to the integrated circuit, the button is also the horn of the unicorn, and when the button is pressed, it sends a signal to the integrated circuit where the integrated circuit, upon receiving this signal, causes the wings to flap, the speaker to emit sound, or both, and where the magnetic switch is triggered by creating a magnetic field in close proximity to the magnetic switch, the magnetic switch is located in a nose of the toy unicorn, where the magnetic switch is connected to the integrated circuit, and when the switch is activated, it sends a signal to the integrated circuit, where the integrated circuit, upon receiving this signal, causes the wings to flap, the speaker to emit sound, or both.

11. The child's toy of claim 10, where the speaker emits sounds of a horse running.

12. The child's toy of claim 10, where the speaker emits sounds of a horse neighing.

13. The child's toy of claim 10, where the speaker is located in a abdomen of the toy unicorn.

14. The child's toy of claim 10, where the toy unicorn has a lower power mode, and where the integrated circuit, when the toy unicorn is in the low power mode, will not respond to signals from the magnetic switch, but upon receiving a signal from the button, will once again respond to signals from the magnetic switch.

15. The child's toy of claim 10, where the toy unicorn further comprises lights, where these lights are located in the wings, and where the lights are constantly lit while the wings are flapping.

16. The child's toy of claim 10, where the toy unicorn further comprises lights, where these lights are located in the wings, and where the lights flash on and off while the wings are flapping.

17. A child's toy unicorn consisting of:

a head with an attached horn, wherein the head is attached to a body having four legs, a power source, an integrated circuit, a button, a motor, a magnetic switch, a speaker, and wings on said body, where the power source supplies electricity to the integrated circuit where the speaker and the motor are connected to the integrated circuit, and where the integrated circuit can send a signal to the speaker causing it to emit sound and where the integrated circuit can send a signal to the motor causing it to turn, where the motor is connected to the wings, and when the motor turns, the wings flap up and down, where the button is connected to the integrated circuit, the button is also the horn of the unicorn, and when the button is pressed, it sends a signal to the integrated circuit where the integrated circuit, upon receiving this signal, causes the wings to flap, the speaker to emit sound, or both, and where the magnetic switch is triggered by creating a magnetic field in close proximity to the magnetic switch, the magnetic switch is located in a nose of the toy unicorn, where the magnetic switch is connected to the integrated circuit, and when the switch is activated, it sends a signal to the integrated circuit, where the integrated circuit, upon receiving this signal, causes the wings to flap, the speaker to emit sound, or both.

* * * * *